US005730314A

United States Patent [19]

Wiemann et al.

[11] Patent Number: 5,730,314

[45] Date of Patent: Mar. 24, 1998

[54] CONTROLLED GROWTH CAN WITH TWO CONFIGURATIONS

[75] Inventors: David J. Wiemann, O'Fallon; David H. Henkelmann, Imperial, both of Mo.

[73] Assignee: Anheuser-Busch Incorporated, St. Louis, Mo.

[21] Appl. No.: 818,599

[22] Filed: Mar. 14, 1997

Related U.S. Application Data

[63] Continuation of Ser. No. 451,890, May 26, 1995, abandoned.

[51] Int. Cl.[6] ..... B65D 21/00

[52] U.S. Cl. ..... 220/609; 220/606

[58] Field of Search ..... 220/604, 605, 220/606, 609, 628, 629

[56] References Cited

U.S. PATENT DOCUMENTS

| | | | |
|---|---|---|---|
| 3,409,167 | 11/1968 | Blanchard | 220/66 |
| 3,904,069 | 9/1975 | Toukmanian | 220/66 |
| 3,979,009 | 9/1976 | Walker | 220/66 |
| 4,037,752 | 7/1977 | Dulmaine et al. | 220/70 |
| 4,120,419 | 10/1978 | Saunders | 220/609 |
| 4,125,632 | 11/1978 | Vosti et al. | 220/606 X |
| 4,147,271 | 4/1979 | Yamaguchi | 220/70 |
| 4,174,782 | 11/1979 | Obsomer | 220/608 X |
| 4,222,494 | 9/1980 | Lee, Jr. et al. | 220/66 |
| 4,381,061 | 4/1983 | Cerny et al. | 215/1 |
| 4,412,627 | 11/1983 | Houghton et al. | 220/66 |
| 4,426,013 | 1/1984 | Cherchian et al. | 220/66 |
| 4,431,112 | 2/1984 | Yamaguchi | 220/70 |
| 4,542,029 | 9/1985 | Caner et al. | 220/606 X |
| 4,836,398 | 6/1989 | Leftault, Jr. et al. | 220/609 |
| 4,880,129 | 11/1989 | McHenry et al. | 220/606 X |
| 5,421,480 | 6/1995 | Cudzik | 220/624 |
| 5,477,977 | 12/1995 | Cudzik | 220/636 |

*Primary Examiner*—Steven M. Pollard
*Attorney, Agent, or Firm*—Sidley & Austin

[57] ABSTRACT

A drawn and ironed can having a generally cylindrical side wall and an integral bottom including two annular rims is provided. The bottom of the can has a reduced volume configuration, wherein the upright can rests on an outer annular rim known as the heel, and an expanded volume configuration, wherein the upright can rests on an inner annular rim known as the nose. When a can in the reduced volume configuration is subject to an elevated internal pressure substantially less than the maximum working pressure, a portion of the can bottom comprising the nose moves axially downwardly relative to the rest of the can to serve as a new base, thus transitioning the can into the expanded volume configuration.

18 Claims, 4 Drawing Sheets

CONTROLLED GROWTH CAN WITH TWO CONFIGURATIONS

CROSS REFERENCE TO RELATED APPLICATIONS

This is a continuation of U.S. patent application Ser. No. 08/451,890, filed May 26, 1995, now abandoned.

TECHNICAL FIELD OF THE INVENTION

This invention relates to sealed cans and components thereof subject to internal pressure above ambient pressure during processing. In particular, the invention relates to a can having controlled deformation from a lower volume configuration to a higher volume configuration to reduce the maximum working pressure the can must be designed to handle.

BACKGROUND OF THE INVENTION

1. Can Components and Construction

The conventional two-piece can includes two principal components, namely a can body and a lid (or top end). The can body includes a very thin, generally cylindrical, side wall and a thin, generally upwardly extending domed bottom formed integrally with the side wall at one end of the side wall. The opposite end of the can body side wall is joined to the separately formed top, typically with a double seam, but only after a carbonated beverage or other gas-charged/gas producing product has been introduced into the internal cavity provided by the can body. Can bodies are typically constructed using an aluminum alloy or, less frequently, steel or other materials, and are normally fabricated by a drawing and ironing operation.

In the drawing and ironing operation, a plurality of circular blanks of metal are initially punched from a thin metal sheet stock. Each blank is then drawn into the form of a relatively shallow cup. Next, in a sequence of ironing operations, the cup is placed over the end of a punch and forced through a set of dies which stretch and thin the side wall significantly until the cup becomes a can body having a desired height. However, the bottom of the can retains essentially the original thickness of the sheet stock even after the side wall is ironed. In the last ironing step, the punch also presses the bottom of the can body against an end-forming die to impart a generally upwardly extending domed configuration to it, i.e., such that the center of the bottom of the can body extends toward the interior of the can body further than the periphery of the bottom of the can body. After ironing, the top portion of the side wall is trimmed to ensure a flat top edge. The finished can bodies go through a number of additional operations, e.g., washing, decorating, curing, necking, and inspection, before being filled and then sealed with a lid.

2. Design Considerations

The design of a two-piece can must address and balance three often conflicting factors. First, the can must withstand physical forces-both internal forces arising from the pressure of the can's contents, and external forces experienced at different points in the can's service life. Failure to withstand physical forces results in obvious defects, such as punctures, which allow the contents of the can to escape or spoil, but it also results in undesirable physical deformation of the can, such as pressure-induced buckling of the lid (lid failure) or partial or total reversal of the domed bottom, which cause the can to be unsalable. Second, the can must require as little material as possible in its construction. Two-piece metal beverage cans are currently produced in quantities exceeding 90 billion cans per year in the United States; therefore, even a small reduction in the material required for each can produces significant economic benefits. Finally, a can design must have external characteristics that are compatible with the equipment and environmental conditions encountered during all phases of its life cycle, including production, filling and seaming, packaging, transportation, retailing, stacking and consumer use.

A typical balancing issue arises when the necessary maximum allowable pressure of a can conflicts with attempts to reduce the amount of material used in the construction of the can. The maximum allowable pressure of the can is the maximum internal pressure it can withstand without suffering excessive deformation or pressure-induced failure. To withstand internal pressures arising from a typical commercial volume, or "fill," of carbonated beverage at maximum values of the generally accepted ranges of carbonation, temperature (e.g., during heat pasteurization of beer), or physical agitation (e.g., rough shipping or handling), conventional cans currently require a maximum allowable pressure of 90 to 95 psig. "Lightweighting" refers to design modifications which decrease the overall amount of aluminum or other material used in the can, often by redesigning the lid or bottom profile or using thinner sheet stock for one or both of the two components. These efforts may result in reduced resistance of the lid or the concave domed bottom, to undesirable deformation. Thus, in general, lightweighting efforts must stop when they reduce the strength of the can below the necessary maximum allowable pressure.

To allow further lightweighting efforts, some cans are designed to allow controlled deformation, or "growth," of the can structure when environmental conditions cause the internal pressure to approach the maximum allowable pressure. This designed growth increases the internal volume of the can, causing a corresponding reduction in the interior pressure and thereby forestalling pressure-induced failure. In effect, this designed growth reduces the maximum internal pressure for given product fill volume, carbonation factor, and physical conditions, thus allowing the can's maximum allowable pressure to be lowered, and lightweighting efforts to progress.

However, in previous can designs allowing for can growth, the extent and location of the pressure-induced growth was highly dependent upon the specific design profile of the can bottom and the pressure history experienced by an individual can. This resulted in finished cans having variable dimensions in certain critical areas, adversely affecting the use of the can by the packager, shipper, retailer, and consumer.

A need exists, therefore, for a can having an ability for controlled growth such that maximum internal pressure is reduced for a given fill of product and physical conditions, and having finished dimensions that are only minimally dependent upon the pressure history of the individual can.

Among the external forces a can must withstand are axial loads imposed during filling and seaming operations. Conventional automated filling and seaming equipment presses down with great force on the upper rim of the can. The ability of the can to withstand these axial loads is termed "column strength." The supporting surfaces on the bottom of the can, which may comprise one or more annular surfaces or sets of discrete discontinuous surfaces, are typically called the bearing surfaces. This bearing surface is especially prone to failure during the filling and seaming operation, and this presents an obstacle to further lightweighting.

A need exists, therefore, for a controlled growth can having sufficient column strength to allow conventional filling and seaming operations.

Empty cans, especially if made of aluminum, are very light in weight. As a result, such cans are prone to topple from their upright position during processing in the brewery or canning plant, thereby causing increased can wastage and often disrupting operations. An important factor relating to the mobility of empty cans is the effective diameter of the bearing surface upon which an upright can rests, i.e., the diameter of a circle passing through the bearing surface of the can bottom. This diameter is known as the stand diameter.

A need exists, therefore, for a controlled growth can having a large stand diameter when empty such that the empty can exhibits good stability during movement.

After filling the can body with product and sealing it by seaming on a lid, the overall weight of a can is greatly increased. Because of this increased weight, the primary factor affecting filled-can mobility is sliding friction between the bearing surface of the can and the work surfaces of equipment such as conveyers. Since bare aluminum is relatively soft and does not slide well on many surfaces, a friction-reducing "mobility coating" is commonly applied to the bearing surface of a can. While effective at reducing friction, mobility coatings degrade rapidly during processing due to abrasion. If the aluminum underlying the mobility coating is exposed by this degradation, friction increases significantly, as do associated operating problems.

A need exists, therefore, for a controlled growth can having a first bearing surface which is replaced with a second bearing surface during processing, where the second bearing surface was protected from abrasion while the first bearing surface was in use.

For the purposes of transportation, storage, and display, it is important that a filled, finished can be stackable, i.e., that the bottom surfaces of one can are precisely dimensioned to cooperate with the lid surfaces of a similar can directly below. Stackability is typically achieved by providing a can with a projecting bottom and a recessed lid such that the bottom of one such can fits precisely into or around the recessed lid of a similar can directly below but the bottom of the upper can does not touch the lid tab, rivet, or lid score features on the lid of the can below. In previous cans that allowed for can growth, the pressure-induced growth often produced unpredictable variations in the dimensions of can features critical for stackability, such as the annular rim on the bottom end wall. These variations had an undesirable effect on stackability.

A need exists, therefore, for a controlled growth can having predictable dimensions for can features critical to stackability, regardless of the pressure history of the individual can.

For purposes of product appearance, production handling, and ease of transportation, it is desirable to minimize variations in the finished overall height of a can. Many previous can designs used deformation of the bottom of the can to provide volumetric expansion to reduce internal pressure. Such cans often experienced height increases which were proportional to the maximum internal pressure experienced. Depending upon the design, such "growth" may or may not be reversible if the internal pressure is subsequently reduced. As a result of variations in filling, processing, handling, and other conditions, there may be considerable variation in the height of filled cans using previous can bottom designs.

A need exists, therefore, for a controlled growth can having a predictable overall package height after growth has occurred, regardless of conditions or the pressure history of the individual can.

For some cans using volumetric expansion to control internal pressure, the "expanded" structure of the can has a relatively wide, unsupported annular surface on the bottom between the bearing surface and the can side wall. Such an unsupported surface tends to flex repeatedly, especially when subjected to load and vibration during shipment and handling. This repeated flexing may result in fatigue cracking of either the can body material itself or one of the protective coatings applied to the interior or exterior surface of the can. In any case, such cracking is considered to be a failure of the can.

A need exists, therefore, for a controlled growth can having a bottom with only a narrow, relatively stiff annular section between the bearing surface and the can side wall.

While some products, such as traditional beers, are pasteurized or heat-treated after canning to eliminate pathogens, other products such as draft beers and carbonated soft drinks are produced using aseptic equipment or other facilities that do not require such heat treatment. Significantly higher internal pressures are generated in a can which is heat treated as compared to a can which is asepticly processed. It is desirable for manufacturers to produce a single can body design which can be used for all of these applications.

A need exists, therefore, for a controlled growth can having finished characteristics that are not dependent upon whether pasteurized, aseptic, or other production methods are used.

The detection of leaking cans under high-speed production conditions is another problem faced by can producers. In the case of minor leaks, the leak may not be readily apparent from the appearance of the can exterior. While radiation-based level detectors have been used, their performance for leak detection is subjective.

A need exists, therefore, for a controlled growth can having an external indication of leakage.

"Head space" refers to the partial can volume intentionally left empty of liquid during the filling process. In many cans, head space is provided in order to allow room for liquid expansion and for some of the dissolved $CO_2$ in the liquid carbonated product to evolve into gas in the head space. However, head space can be a problem for two reasons. First, a large head space increases the chance that undesirable gases (also called "airs") will be introduced into the can during the filler/seamer transfer operation. These gases, primarily oxygen, tend to oxidize or otherwise degrade the product. Second, cans relying on head space alone to reduce the maximum internal pressure may experience over-pressuring if the can is overfilled during the filling operation, since this will necessarily cause the volume of the head space to be less than design specifications.

A need exists, therefore, for a controlled growth can having a decreased requirement for headspace during filling and a decreased sensitivity to overfilling.

3. Prior Art

The prior art contains many cans and containers, including those disclosed in U.S. Pat. Nos. 3,409,167, 3,904,069, 3,979,009, 4,037,752, 4,147,271, 4,222,494, 4,381,061, 4,412,627, 4,426,013, and 4,431,112. However, prior art cans typically focus on an improvement to only a single factor of can design, such as reduced maximum working pressure, rather than improvements to multiple factors.

For example, U.S. Pat. No. 3,979,009 to Walker discloses a bottom for a seamless metal container body wherein the central portion of the bottom includes a stiffening embossment that is joined to the other portions of the bottom by a hinge-like section that permits outward flexing or bulging of the bottom when the container is sealed and subjected to internal pressures. While this can may provide pressure reduction through volumetric expansion, reference to FIGS. 1 and 3 of the '009 patent reveals that the resulting bottom profile has very low stackability (i.e., if the can is stacked on a similar can, the bottom bearing surface, in either the original state or the "extended" state, will not fit within the rim of a similar lid so as to prevent lateral motion). Furthermore, as shown in FIG. 3, the can bottom in its "extended" shape has two wide, unsupported annular surfaces stretching outwardly from the primary annular stabilizing ring structure 26 to the third stabilizing ring structure 34. Such a wide unsupported annular surfaces are prone to cause repeated flexing and fatigue cracking of the can material or protective coatings.

Another example is U.S. Pat. No. 3,904,069 to Toukmanian, which discloses a metal cylindrical can body having a bottom wall structure that includes a centrally disposed circular depression 28 and which permits the can to expand in height, when subjected to internal pressure, by deforming into a shape in which the wide annular rim 26 of the depression 28 forms a base on which the can sits. While this can may provide pressure control through volumetric expansion, reference to paired FIGS. 1 and 5, and 2 and 6, respectively, of the '069 patent reveals that the resulting bottom profile of this can also has very low stackability. Furthermore, as shown in FIG. 11 of the '069 patent, the mobility of the filled can will be relatively low because the diameter of the bearing surface formed by the edge 30 of the depression 28 is small, and the mobility coating on the bearing surface is subject to continual degradation.

Yet other examples are U.S. Pat. Nos. 4,147,271 and 4,431,112 to Yamaguchi. These patents disclose variations of a drawn and ironed can body having a thinned bottom with a central portion which distends under internal pressure and an outer peripheral portion provided with buckling resistant strength sufficient to withstand the internal pressure. In the '271 patent, the central portion of the bottom is flat, as shown in FIGS. 10 and 14 of the '271 patent. In the '112 patent, the central portion is domed, as shown in FIG. 12 of the '112 patent. As with the Walker and Toukmanian, Yamaguchi thus provides pressure control through volumetric expansion. However, only the central portion of the bottom distends, as indicated by the dotted line in FIG. 14 of the '271 patent, and even in its distended form, this central portion remains above the end plane of the original can bottom. The outer peripheral portion of cans constructed according to Yamaguchi distends very little. Thus, the amount of volumetric expansion and pressure control achieved by Yamaguchi-type cans is small relative to cans in which the entire bottom wall extends. In addition, the stackability of cans constructed according to Yamaguchi may be impaired by the distension of the central portion of the bottom of one can into the area to be occupied by the lid of a second can stacked below. Further, the filled-can mobility of Yamaguchi-type cans will be impaired since only a single bearing surface, namely the outer peripheral portion of the bottom, is used despite its degradation during manufacture, production handling and transportation.

SUMMARY OF THE INVENTION

This invention relates to a two-piece can and, more particularly, to a two-piece can having an improved bottom wall configuration having two distinct structural configurations, a reduced volume configuration and an expanded volume configuration, transition between these configurations occurring when the internal pressure of the can is substantially less than the maximum working pressure (i.e., the failure pressure less a margin of safety) of the can.

One of the principal objects of the present invention is to provide a can having a capacity for controlled growth so that the maximum internal pressure is reduced for a given volume of product and given physical conditions, and having finished dimensions that are only minimally dependent upon the pressure history of the individual can. Another object is to provide a controlled growth can having sufficient column strength to allow conventional filling and seaming operations. A further object is to provide a controlled growth can having a large stand diameter when empty, so that the empty can exhibits good mobility, i.e., stability during movement. An additional object is to provide a controlled growth can having a first bearing surface which is replaced after use with a second bearing surface which was previously protected from abrasion while the first bearing surface was in use. Yet another object is to provide a controlled growth can having predictable dimensions for can features critical to stackability, regardless of the pressure history of the individual can. Still another object is to provide a controlled growth can having a predictable, overall package height after growth has occurred, regardless of conditions or the pressure history of the individual can. A further object is to provide a controlled growth can having a bottom end wall with only short, relatively stiff annular sections between the bearing surface and the side wall. An additional object is to provide a controlled growth can having finished characteristics that are not dependent upon whether pasteurized, aseptic, or other production methods are used. Yet another object is to provide a controlled growth can having an external indication of any leakage. Still another object is to provide a controlled growth can having a reduced requirement for head space to reduce sensitivity to over-filling, and to reduce the amount of undesirable "airs" in the can.

The present invention is embodied in a two-piece can having a can body and a lid. The can body is formed with a generally cylindrical side wall, having upper and lower end portions, and a bottom formed integrally with the lower end portion of the side wall. The bottom of the can body includes an outer annular rim, an annular hinge, an inner annular rim, and an inwardly and upwardly directed dome.

The outer annular rim is called the heel section, and includes an annular bottom margin of the side wall (or outer heel wall), an inner annular heel wall, and an annular heel transition section which joins the annular body margin of the side wall to the inner heel wall. The heel angle is defined by the angle formed by the intersection of a line which is an extension of a main portion of the side wall and a line which is an extension of the inner heel wall, both lines being in a plane that includes the central longitudinal axis of the can body. The heel angle in the reduced volume configuration is selected so as to allow the heel angle to increase when the internal can pressure exceeds the ambient external pressure by a predetermined amount. The outer periphery of the outer heel wall is joined with the bottom end of the side wall continuously about the outer circumference of the outer heel wall.

The annular hinge is called the hinge section and has an annular outer hinge wall, an annular inner hinge wall, and an annular hinge transition section which joins the outer hinge wall to the inner hinge wall. The hinge angle is defined as the angle formed by the intersection of a line which is an extension of the outer hinge wall and a line which is an extension of the inner hinge wall, both lines being in a plane that includes the longitudinal central axis of the can body. The hinge angle in the reduced volume configuration is selected so as to allow the hinge angle to increase when the internal can pressure exceeds the ambient external pressure by a predetermined amount. The outer hinge wall is continuous with the inner heel wall.

The inner annular rim is called the nose section and has an annular outer nose wall, an annular inner nose wall, and an annular nose transition section which joins the inner nose wall to the outer nose wall. The nose angle is defined by the angle formed by the intersection of a line which is an extension of the outer nose wall and a line which is an extension of the inner nose wall, both lines being in a plane that includes the longitudinal central axis of the can body. The nose angle in the reduced volume configuration is selected to hinder or resist increases in the nose angle when the internal can pressure exceeds ambient external pressure by the predetermined amount that causes increases in the heel angle and hinge angle. The outer periphery of the outer nose wall is continuously connected to the inner periphery of the inner hinge wall.

The inner edge of the inner nose wall is continuously connected to the outer peripheral edge of the dome. The hinge section is movable between a first hinge position and a second hinge position. The movement of the hinge section from the first hinge position to the second hinge position also causes the inner heel wall to move from a first heel position to a second heel position. This movement of the heel section and the hinge section causes the nose section and the dome section to move relative to the heel section without significant changes in the configuration of the dome or nose section.

Carbonated beverages or other gas-charged or gas-producing liquids are introduced into the cavity of the can body when the can body is in the reduced volume configuration. After the introduction of a carbonated beverage, the lid is joined to the can body at the second end of the side wall, forming a pressure-tight seal with the can body. Controlled deformation of the heel section and the hinge section is caused when the internal pressure within the can reaches a predetermined value, causing the nose section and the dome to move downwardly to a position wherein the lower portion of the nose section extends below the heel section.

Another aspect of the present invention is a method of storing carbonated beverages, utilizing a controlled growth can. One embodiment of this aspect of the invention comprises forming a controlled growth can body having the heel section in the reduced volume heel position and the hinged section in the reduced volume hinge position, filling the can body with beer or other carbonated beverage, seaming a lid to the second end of the side wall of the can body with a pressure-tight seal, thereby forming a sealed can, and thereafter deforming the heel section from the reduced volume heel position into the expanded volume heel position, and the hinged section from the reduced volume hinge position into the expanded volume hinge position by means of an internal pressure within the sealed can.

Another embodiment of this aspect of the present invention comprises the steps of forming a controlled growth can body with the bottom of the body having the heel section in a expanded volume heel position, and the hinged section in the expanded volume hinge position, preparing the can body for a first configuration change, deforming the heel section from the expanded volume heel position into the reduced volume heel position, and the hinged section from the expanded volume hinge position into the reduced volume hinge position, filling the can body with beer or other carbonated beverage, seaming a lid to the second end of the side wall of the can body with a pressure-tight seal, thereby forming a sealed can, and thereafter deforming the heel section from the reduced volume heel position into the expanded volume heel position, and the hinged section from the reduced volume hinge position into the expanded volume hinge position by means of an internal pressure within the sealed can.

In a further embodiment of this invention, the preparation for the step of a first configuration change comprises applying a protective coating to the interior of the can body. The coating application is performed before the first configuration change, because the interior contours of the can bottom may be more conducive to even coating prior to the configuration change. In additional embodiments of the present invention, the step of preparing for a first configuration change comprises various methods of stabilizing the side walls of the can body. In yet another embodiment of the present invention, the step of preparing for a first mode change comprises applying heat to a localized region of the bottom of the can body until the region reaches a predetermined temperature. After preparing the can body, an axial load is applied to obtain a desired heel position. In still another embodiment of the present invention, the first deforming step comprises applying a compressive axial force at opposite ends of the can body until the heel section deforms from the expanded volume heel position to the reduced volume heel position, and the hinge section deforms from the expanded volume heel position to the reduced volume heel position. In a further embodiment of the present invention, the first deforming step comprises connecting the can body at the second end of the side wall to a fixture, and spin-forming the features of the bottom until the heel section deforms from the expanded volume heel position to the reduced volume heel position, and the hinge section deforms from the expanded volume hinge position to the reduced volume hinge position. In a further embodiment of the present invention, the first deforming step comprises inserting segmented tooling into the can body until it rests against the interior surface of the heel section of the bottom, and applying a compressive axial force to the tooling and to the nose section of the bottom until the heel section deforms from the expanded volume heel position to the reduced volume heel position, and the hinge section deforms from the expanded volume hinge position to the reduced volume hinge position.

Other objects and advantages will appear in the course of the following description:

DETAILED DESCRIPTION

In the following description, references to up, down, above, below, and similar directional terms correspond to a can positioned upright on a flat surface, i.e., with the end having the separately formed lid positioned directly above the bottom end formed integrally with the side walls of the can body. References to inner, outer and similar directional terms relating to annular features correspond to directions toward and away from, respectively, the longitudinal central axis of the can body.

Figure 1:
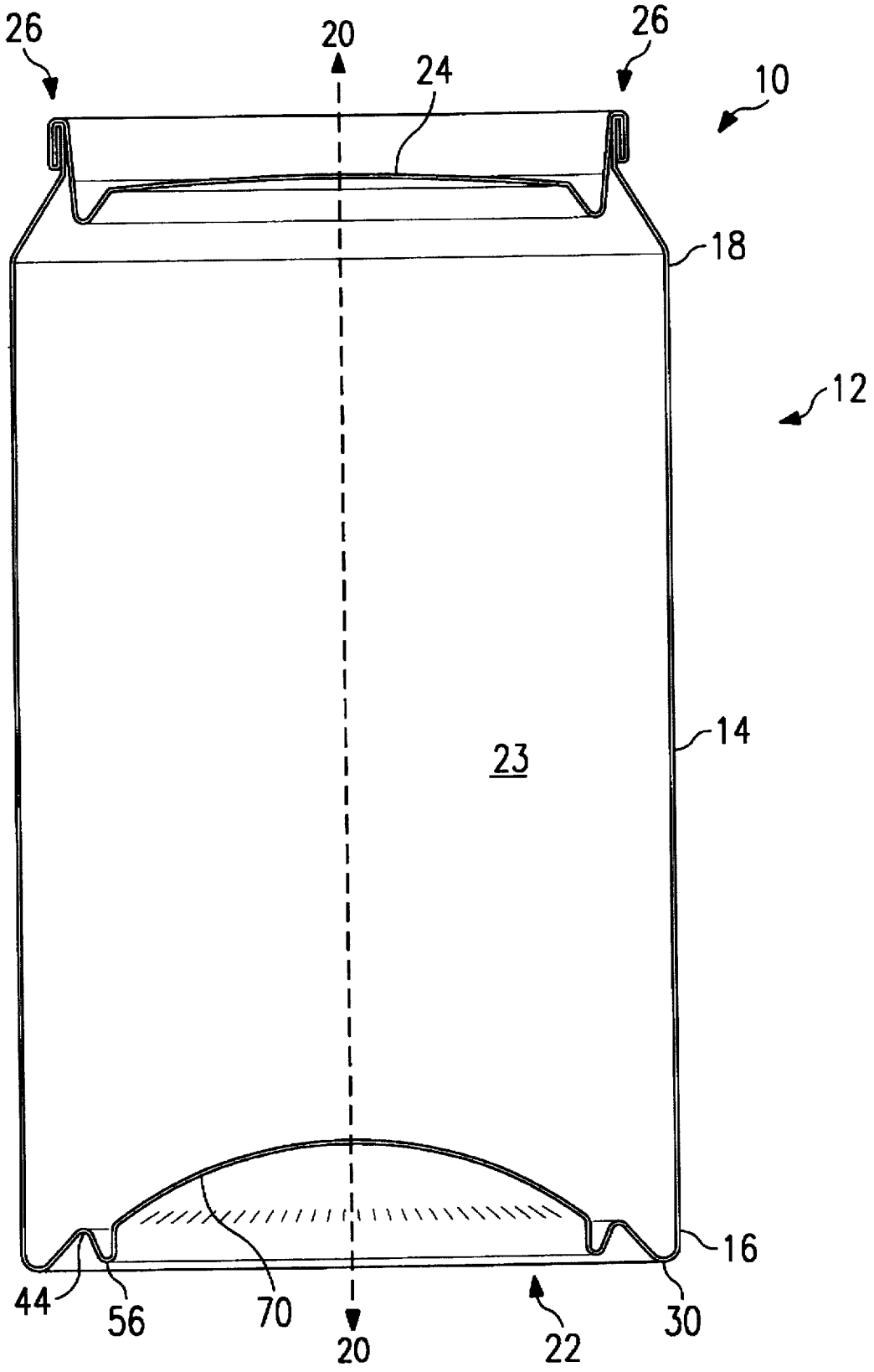
FIG. 1 is a cutaway elevational view of a controlled growth can constructed in accordance with the present invention with the can bottom being in the reduced volume configuration.

Referring to FIG. 1, an overview of a can in accordance with this invention is shown. Can 10 has a can body 12 including a generally cylindrical side wall 14 having lower end portion 16, upper end portion 18, and a longitudinal central axis 20. While side wall 14 is most commonly constructed in the form of a circular cylinder which is symmetrical about longitudinal axis 20, those skilled in the art will appreciate that other generally cylindrical configurations are possible including an embossed or fluted cylinder or a cylinder comprising a plurality of flat rectangular facets. Can body 12 has a bottom 22 formed integrally with lower end portion 16 of side wall 14. Can bottom 22 has features including an annular heel section 30, an annular hinge section 44, and an annular nose section 56. A lid 24 is joined to can body 12 by means of a pressure tight seal 26 at upper end 18 of side wall 14. Lid 24 is generally sealed to can body 12, forming a complete can 10, only after beer, carbonated beverage, or other product has been introduced into the cavity 23 of can body 12. After being sealed within the can, the product is still subject to environmental conditions, such as heating, cooling and vibration, which can cause gas to evolve from the liquid phase of the product, thereby producing changes in the internal pressure within the sealed can. Annular heel section 30 may be continuous with lower end portion 16 of side wall 14 and with the outer periphery of hinge section 44. Annular hinge section 44 may be continuous with the inner periphery of heel section 30 and with the outer periphery of nose section 56. Annular nose section 56 may be continuous with the inner periphery of hinge section 44 and with the outer periphery of dome 70.

Figure 2:
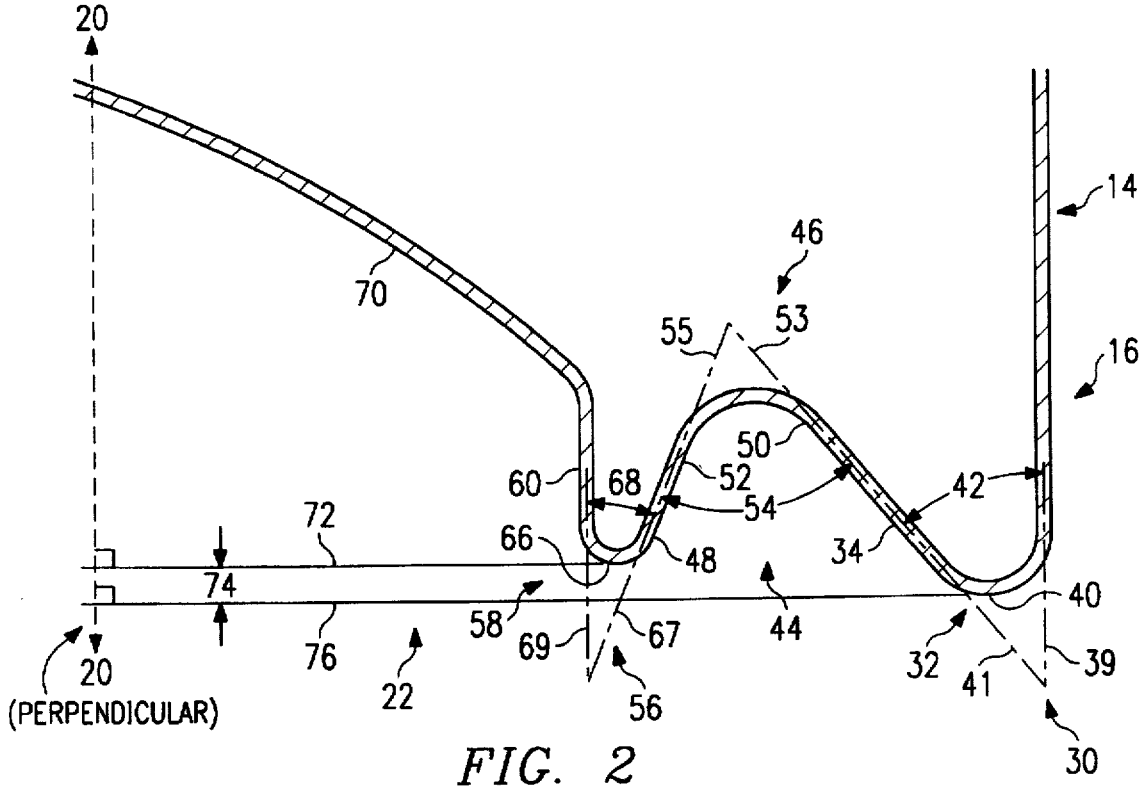
FIG. 2 is a partial elevation view, in cross section, showing a portion of a basic profile of the bottom of a controlled growth can in accordance with this invention, illustrating the basic profile of the peripheral portion of the can bottom when the bottom is in the reduced volume configuration.
Figure 3:
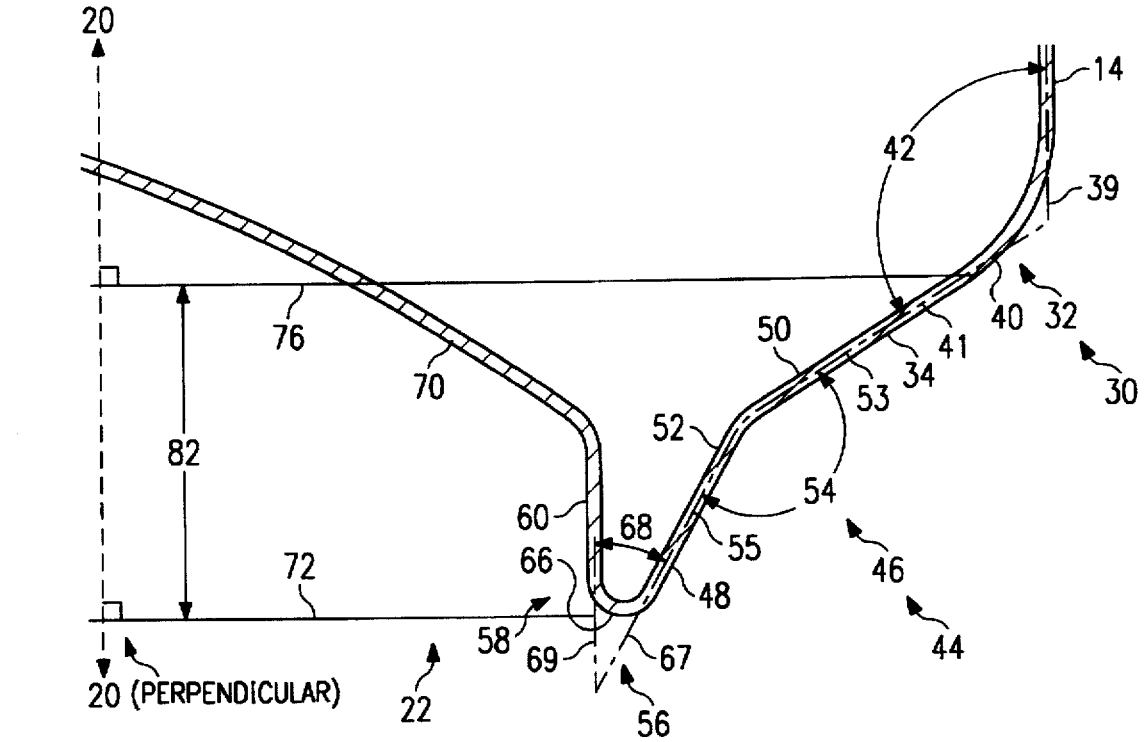
FIG. 3 is a partial elevation view, in cross section, showing a portion of a basic profile of the bottom of a controlled growth can in accordance with this invention, illustrating the basic profile of the peripheral portion of the can bottom when the bottom is in the expanded volume configuration.

Referring to FIGS. 2 and 3, a portion of side wall 14 and can bottom 22 is shown with can bottom 22 being in a reduced volume configuration in FIG. 2, and being in an expanded volume configuration in FIG. 3. Can bottom 22 has features including an annular heel section 30, an annular hinge section 44, and an annular nose section 56.

The heel section 30 includes an annular heel transition section 32 and an inner heel wall 34. The outer periphery of heel transition section 32 may connects to the lower end portion 16 of side wall 14, while the inner periphery of the heel transition section 32 may connect to the outer periphery of the inner heel wall 34. The heel angle 42 of can body 12 is the angle formed by the intersection of line 39, which is a downwardly directed extension of a main portion of the side wall 14, and line 41, which is an outwardly directed extension of inner heel wall 34, both lines 39 and 41 being in a plane that includes longitudinal axis 20. Inner heel wall 34 is movable between a reduced volume heel position shown in FIG. 2, and an a expanded volume heel position shown in FIG. 3. As shown in FIG. 2, heel angle 42 has a first value when inner heel wall 34 is in the reduced volume heel position. As shown in FIG. 3, heel angle 42 has a second value when inner heel wall 34 is in the expanded volume heel position. The heel transition section 32 has an annular line 40 representing the lowermost portion under heel wall 34 in the reduced volume heel position shown in FIG. 2. This annular line may be either continuous or discontinuous depending upon the exact configurations of the heel section. The annular line 40 serves as the bearing surface when the can in a reduced volume configuration is sitting upright on a support surface.

The first value of heel angle 42 must be selected so as to allow the heel angle 42 to increase to the second value of heel angle 42 when the internal can pressure exceeds external ambient pressure by a predetermined amount and before the nose angle 68 increases significantly. The exact minimum first heel angle 42 has not been determined; however, it is believed that a first heel angle 42 less than 30° would effectively prevent the heel angle from increasing before the nose angle 68 began increasing significantly at an internal pressure low enough to be beneficial.

Bottom 22 also has a hinge section 44 with an outer hinge wall 50, inner hinge wall 52, and hinge transition section 46. Hinge transition section 46 may connect to outer hinge wall 50 and inner hinge wall 52. Hinge section 44 is movable between a first hinge position and a second hinge position.

As shown in FIG. 2, the hinge section 44 includes an annular hinge transition section 46, an annular outer hinge wall 50, and an annular inner hinge wall 52. The outer periphery of outer hinge wall 50 may connect to the inner periphery of inner heel wall 34, while the inner periphery of outer hinge wall 50 may connect to the outer periphery of hinge transition section 46. The inner periphery of hinge transition section 46 may connect to the outer periphery of inner hinge wall 52. The hinge angle 54 of can body 12 is the angle formed by the intersection of line 53, which is an inwardly directed extension of outer hinge wall 50, and line 55, which is an outwardly directed extension of inner hinge wall 52, both lines 53 and 55 being in a plane which includes longitudinal axis 20. Outer hinge wall 50 and inner hinge wall 52 are movable between a reduced volume hinge position, shown in FIG. 2, and an expanded volume hinge position, shown in FIG. 3. As shown in FIG. 2, hinge angle 54 has a first value when inner hinge wall 52 and outer hinge wall 50 are in the reduced volume hinge position. As shown in FIG. 3, hinge angle 54 has a second value when inner hinge wall 52 and outer hinge wall 50 are in the expanded volume hinge position.

Can bottom 22 also has an annular nose section 56 including an annular outer nose wall 48, annular inner nose wall 60, and an annular nose transition section 58. The outer periphery of outer nose wall 48 may connect to the inner periphery of inner hinge wall 52, while the inner periphery of outer nose wall 48 may connect to the outer periphery of nose transition section 58. The inner periphery of nose transition section 58 may connect to the outer periphery of inner nose wall 60, while the inner periphery of inner hose wall 60 is connected to the outer periphery of upwardly directed dome 70. The nose angle 68 of can body 12 is the angle formed by the intersection of line 67, which is an inwardly directed extension of outer nose wall 48, and line 69, which is downwardly or outwardly directed extension of inner nose wall 60, both lines 67 and 69 being in a plane that includes longitudinal axis 20.

Outer nose wall 48 and inner nose wall 60 are movable between a reduced volume nose position, shown in FIG. 2, and an expanded volume nose portion, shown in FIG. 3. Also shown in FIG. 2, nose angle 68 has a first value when outer nose wall 48 and inner nose wall 60 are in the reduced volume nose position. As shown in FIG. 3, nose angle 68 has a second value of when outer nose wall 48 and inner nose wall 60 are in the expanded volume nose position. The nose section 56 has an annular line 66 representing the lowermost portion when outer nose wall 48 and inner nose wall 60 are in the expanded volume nose position shown in FIG. 3. This annular line 66 serves as the bearing surface when can 10 in an expanded volume configuration is sitting upright on a support surface. This annular line 66 may be either continuous or discontinuous depending upon the exact configuration of the heel section.

The first value of nose angle 68 is selected so that it does not increase significantly at internal pressures which are sufficient to initially induce increases in the heel angle 42. Further, it is preferable to minimize the difference between the first value of nose angle 68 and the second value of nose angle 68.

For the purposes of further description, the reduced volume configuration of can bottom 22 is defined as the state when inner heel wall 34 is in the reduced volume heel position and hinge section 44 is in the reduced volume hinge position as generally shown in FIG. 2. The expanded volume configuration of can bottom 22 is defined as the state when inner heel wall 34 is in the expanded volume heel position and hinge section 44 is in the expanded volume hinge position as shown generally in FIG. 3.

Figure 4A:
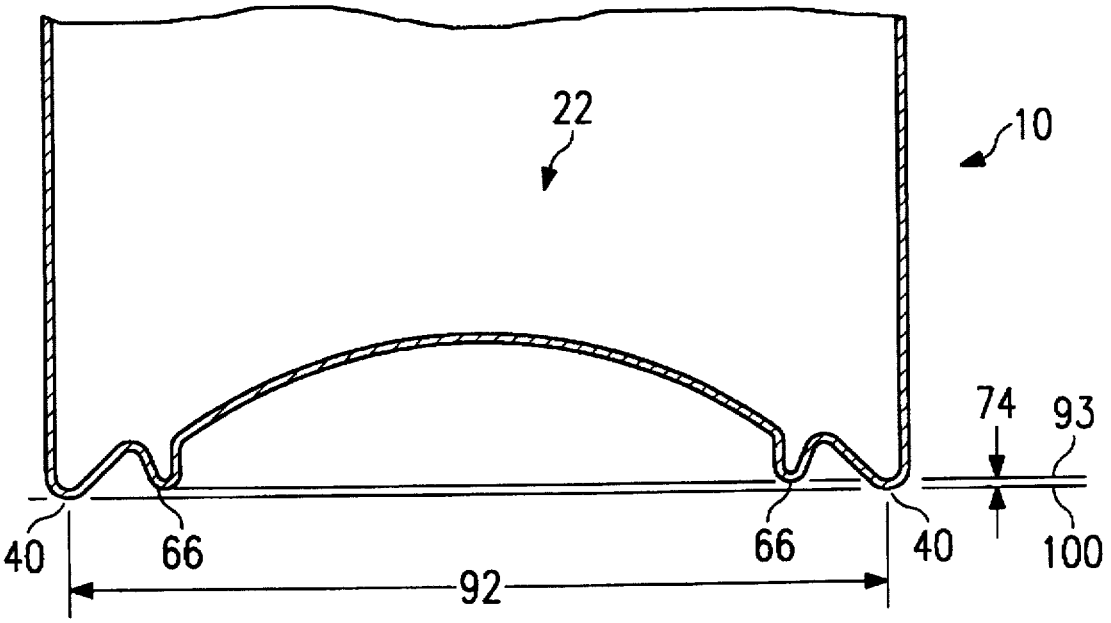
FIG. 4*a* is an elevation view, in cross section, of the bottom of a controlled growth can in accordance with this invention when the can bottom is in the reduced volume configuration.

Referring to FIG. 2, the dimensions of can bottom 22 are selected so that when can bottom 22 is in the reduced volume configuration, a first plane 72, formed perpendicular to the longitudinal axis 20 and containing annular line 66 of nose transition section 58 is spaced a first distance 74 from a second plane 76, formed perpendicular to the longitudinal axis 20 and containing the annular line 40 of heel transition section 32, and first plane 72 is located on the upper side of second plane 76, i.e., the same side as the upper end portion 18 of the side wall 14. Thus, if can 10 is placed upright on a horizontal support surface 100 when bottom 22 is in the reduced volume configuration, as shown in FIG. 4*a*, then can 10 will rest on reduced volume bearing surfaces consisting of the annular line 40 in the heel section 30 and have a first stand diameter 92 equal to the diameter of the annular line 40. Further, nose section 56, in the reduced volume position 93 will be located a first distance 74 above the horizontal support surface 100. However, in a less preferred embodiment, planes 72 and 76 could be the same. In this less preferred embodiment, the reduced volume bearing surfaces would include both heel annular line 40 and nose annular line 66.

Figure 4B:
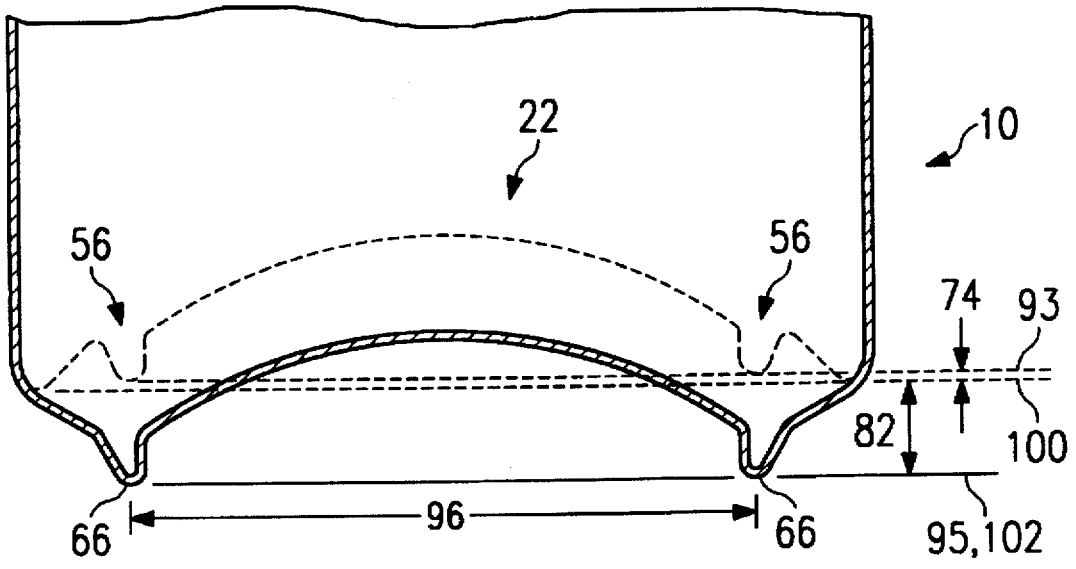
FIG. 4*b* is an elevation view, in cross section, showing the bottom of a controlled growth can in accordance with this invention when the can bottom is in the expanded volume configuration.

As shown in FIG. 3, dimensions of can bottom 22 are selected so that when can bottom 22 is in the expanded volume configuration, first plane 72 through annular line 66 of nose transition section 58 is spaced a second distance 82 from second plane 76 through annular line 40 of heel transition section 32, with first plane 72 being located on the lower side of second plane 76, i.e., the same side as lower end portion 16 of the side wall 14. Thus, as shown in FIG. 4*b*, when can 10 is placed on a horizontal support surface 102 when bottom 22 is in the expanded volume configuration, can 10 will rest on bearing surfaces consisting of nose section annular line 66 and have an expanded volume stand diameter 96 equal to the diameter of the nose section annular line 66. Further, it can be seen that the nose section 56 has initially moved from the nose section reduced volume position 93 (shown in phantom in FIG. 4*b*) a first distance 74 in order to reach former horizontal support surface 100 (shown in phantom) and then additionally moved a second distance 82 in order to reach nose section expanded volume position 95 on horizontal support surface 102. In other words, in the transition from the reduced volume configuration to the expanded volume configuration, the annular line 66 has moved a total distance equal to the sum of distances 74 and 82.

Figure 5:
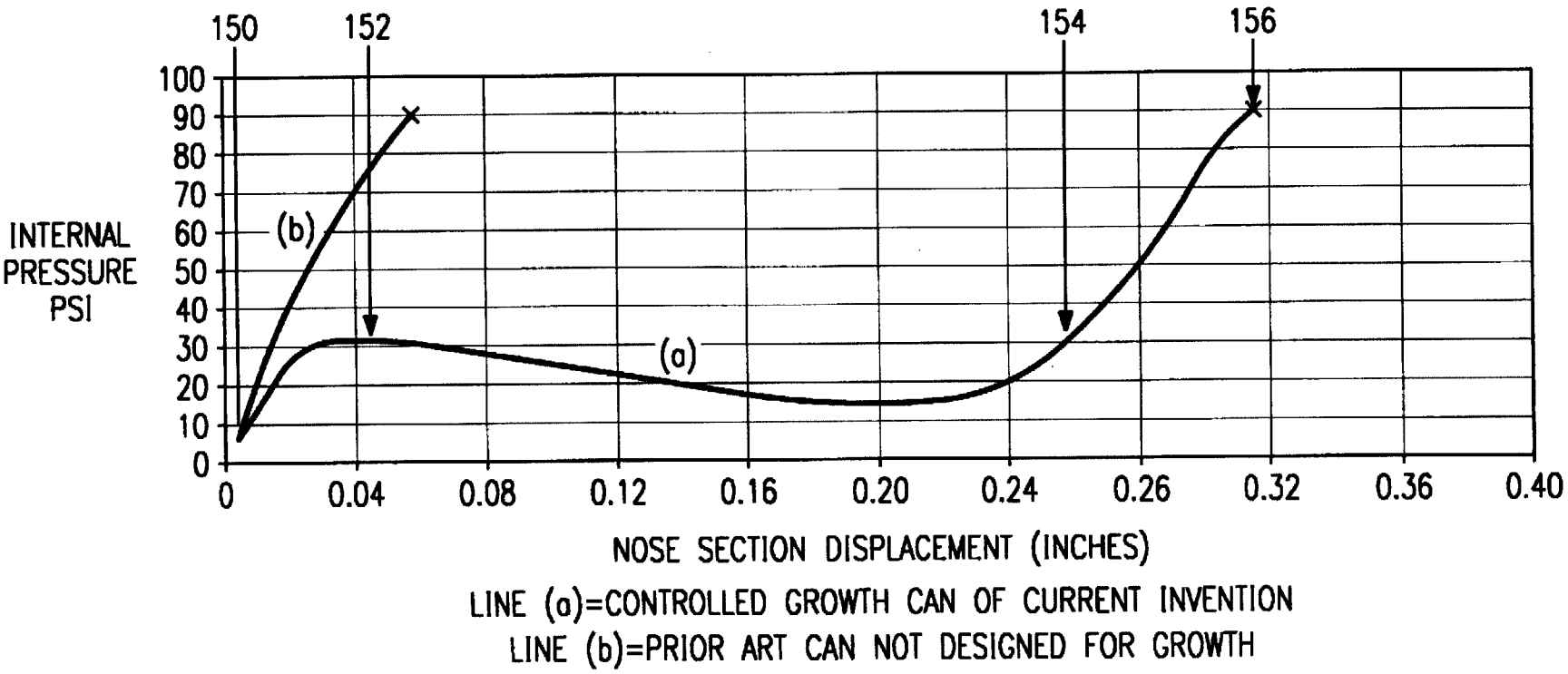
FIG. 5 is a graph of nose section displacement versus internal pressure for a controlled growth can of the current invention and for a prior art can not designed for growth.

Referring to FIGS. 4*a*, 4*b* and 5, the functioning of a controlled growth can of this invention is described. Some prior art cans feature a bottom profile that changes in response to an internal pressure to provide increased internal volume. The unexpected benefit of the present controlled growth can invention is that once the internal can pressure exceeds a predetermined amount, the can bottom profile continues to deform until it reaches a predetermined stable configuration; and hence, the internal volume of the can continues to increase until it reaches a predetermined volume, without requiring any further increasing of internal can pressure.

FIG. 5 shows a graph of the nose section displacement versus internal can pressure as the controlled growth can transforms from the reduced volume configuration to the expanded volume configuration. Referring to FIG. 4*b*, this displacement corresponds to the movement of nose section annular line 66 from the nose section reduced volume position 93 towards the nose section expanded volume position 95 as a function of the internal pressure of the can. Referring to FIG. 5, line (a) shows the nose section displacement versus internal pressure behavior of the controlled growth can of the current invention, while line (b) shows the nose section displacement versus internal pressure behavior of a conventional can not designed for growth. The graph in FIG. 5 includes an initial point 150, a breakover point 152, a transition end point 154 and a terminal point 156. Initial point 150 represents the point at which the controlled growth can in the reduced volume configuration is first subjected to an internal pressure greater than external ambient pressure. As the internal pressure of the can increases from initial point 150, the displacement of the bearing surface initially increases approximately proportional to the increase in the internal pressure. However, once the internal pressure of the can exceeds a predetermined pressure above external ambient pressure, the displacement of the bearing surface continues to increase even though the internal pressure remains constant or is reduced. This "breakover point" is shown at 152 on FIG. 5 for a controlled growth can having a predetermined pressure above external ambient pressure of approximately 30 psig. This displacement of the bearing surface will continue until the transition end point 154 is reached, at which point no further bearing surface displacement is possible without further increasing the internal pressure of the can above the internal pressure of the breakover point 152. Note that the internal pressure of the can at breakover point 152 and at transition end point 154 is approximately equal.

The graph of displacement versus internal pressure between the initial point and the transition end point will not necessarily be a smooth line as shown in FIG. 5. For example, if the internal pressure is being generated by the evolution of carbon dioxide gas from a carbonated beverage, the initial volume increase caused by the displacement of the can following the breakover point may cause a temporary reduction in the internal pressure of the can, momentarily stopping the internal volume increase. As the free $CO_2$ pressure in the can gradually increases, but before the free $CO_2$ pressure exceeds the original breakover point, the bearing surface will be displaced further downwardly. After transition end point 154 has been reached, the behavior of the controlled growth can again resembles the behavior of a conventional can designed for no can growth. Thus, between transition end point 154 and terminal point 156, displacement of the controlled growth can may be approximately proportional to the internal pressure of the can.

To obtain the proper functioning of the controlled growth can of the invention, it is necessary for the bottom profile to be appropriately dimensioned. In a preferred embodiment, can bottom 22 in the reduced volume configuration has a first value of heel angle 42 in the range of about 31° to about 75°, a first value of hinge angle 54 in the range of about 32° to about 104°, a first value of nose angle 68 in the range of 5° to about 45°, and first distance 74 of at least 0.005 inches. Generally, first distance 74 does not exceed 0.100 inch. In the expanded volume configuration of the same preferred embodiment, can bottom 22 has a second value of the heel angle 42 in the range of about 91° to about 132°, a second value of hinge angle 54 in the range of about 94° to about 160°, a second value of nose angle 68 not more than about 12° greater than the first value of nose angle 68, nor less than about 3° less than the first value of nose angle 68, and a second distance 82 of at least 0.150 inch. Generally, the second distance 82 does not exceed 0.390 inch. In this same preferred embodiment, the predetermined internal pressure which causes the bottom to transform from the reduced volume configuration to the expanded volume configuration is at least about 10 psig and not more than about 85 psig.

In a more preferred embodiment, can bottom 22 has a first value of heel angle 42 in the range of about 37° to about 60°, a first value of hinge angle 54 in the range of about 51° to about 83°, a first nose value of angle 68 in the range of about 15° to about 35°, and first value of distance 74 of at least 0.020 inch. In this more preferred embodiment, the first value of distance 74 does not exceed 0.041 inch. In the expanded volume configuration of the same more preferred embodiment, can bottom 22 has a second value of heel angle 42 in the range of about 104° to about 127°, a second value of hinge angle 54 in the range of about 120° to about 153°, a second value of nose angle 68 not more than about 3° greater than the first value of nose angle 68, nor less than about 1° less than the first value of nose angle 68 and a second value of distance 82 of at least 0.201 inch. In this more preferred embodiment, second value of distance 82 does not exceed 0.366 inch. In this same more preferred embodiment, the value of the predetermined internal pressure which will cause the bottom to transform from the reduced volume configuration to the expanded volume configuration is at least about 22 psig and not more than about 65 psig.

In a most preferred embodiment of the current invention, can bottom 22 in the reduced volume configuration has a first value of heel angle 42 in the range of about 44° to about 48°, a first value of hinge angle 54 in the range of about 69° to about 74°, a first value of nose angle 68 in the range of about 25° to about 30°, and first value of distance 74 of at least 0.020 inch. In the most preferred embodiment, the first value of distance 74 does not exceed 0.041 inch. In the expanded volume configuration of this same most preferred embodiment, can bottom 22 in the expanded volume configuration has a second value of heel angle 42 in the range of about 116° to about 122°, a second value of hinge angle 54 in the range of about 140° to about 148°, a second value of nose angle 68 not more than about ½° different from the first value of nose angle 68, and a second value of distance 82 at least 0.251 inch. In this most preferred embodiment, the second value of distance 82 does not exceed 0.346 inch. In this same most preferred embodiment, the value of the predetermined internal pressure which causes the bottom 22 to transition between the reduced volume configuration and the expanded volume configuration is at least about 25 psig and does not exceed about 45 psig.

In yet another embodiment, the current invention comprises a can body for use in making a can having a bottom structure which transitions between a first configuration and a second configuration, where the bottom structure has various combinations of the features described below.

The first such feature is a Two Configuration Bottom, i.e., a bottom structure that transitions from the a reduced volume configuration having:

a) a heel section 30 having a first value of heel angle 42 in the range of about 37° to about 60°;

b) a hinge section 44 having a first value of hinge angle 54 in the range of about 51° to about 83°;

c) a nose section 56 having a first value of nose angle 68 in the range of about 15° to about 35°;

d) a first value of longitudinal distance 74 from the annular line 40 of the heel section to the annular line 66 of the nose section of at least 0.020 inch but not exceeding 0.041 inch and where the annular line 40 of the heel section extends longitudinally downward at least as far as the annular line 66 of the nose section; and e) where the reduced volume configuration is stable in the absence of a difference between the internal can pressure and the external ambient pressure;

to a stable expanded volume configuration having:

a) a heel section 30 having a second value of heel angle 42 in the range of about 104° to about 127°;

b) a hinge section 44 having a second value of hinge angle 54 in the range of about 120° to about 153°;

c) a nose section 56 having a second value of nose angle 68 in the range of about 15° to about 35°;

d) a second value of longitudinal distance 82 from annular line 40 of the heel section to annular line 66 of the nose section of at least 0.201 inch but not exceeding 0.366 inch and where the annular line 66 of the nose section extend longitudinally downward farther than the annular line 40 of the heel section;

e) where the expanded volume configuration is stable in the absence of a difference between the internal can pressure and the external ambient pressure;

when a predetermined value of internal can pressure is exceeded, without further increasing the internal pressure of the can above the predetermined value to effect the continued transition. It will be readily appreciated by those skilled in the art that other ranges and dimensions other than those disclosed above could be used to define the Two Configuration Bottom feature.

The second feature is Wide Annular Dimensions, i.e., the radially measured dimensions from the longitudinal central axis 20 of the can body to the following significant features of the bottom structure, stated as a percentage of the nominal can sidewall radius, i.e., the radius of the central portion of the can side wall, are:

a) longitudinal axis 20 to heel transition section 32—not less than 90% of the radius of can side wall 14;

b) longitudinal axis 20 to hinge transition section 46—not less than 75% of radius of can side wall 14;

c) longitudinal axis 20 to nose transition section 66—not less than 70% of the radius of can side wall 14;

The third feature is Substitute Bearing Surfaces, i.e., in the reduced volume configuration, a first annular portion of the bottom structure serves as the bearing surface for the can when the can is placed upright upon a horizontal support surface, and in the expanded volume configuration, a second annular portion of the bottom structure serves as a bearing surface for the can when the can is placed upright upon a horizontal surface, the second annular portion being separate and distinct from the first annular portion.

The fourth feature is Substantial Overall Growth, i.e., the transition of the bottom structure from the first configuration to the second configuration increases the overall can height, as measured from the lowest point of the can to the highest point of the can in the longitudinal direction, by at least 0.150 inch with can-to-can variation in can height being less than 0.040 inch. In other embodiments, the increase in overall can height may be up to 0.39 inch.

The fifth feature is Stackable Final Bottom Configuration, i.e., in the expanded volume configuration, the bottom structure of the can is stackable with similarly configured cans, i.e., the dimensions of the annular nose section 56 of a first can cooperates with the dimensions of the annular rim 26 of lid 24 of a second, similar can placed directly below so as to resist lateral movement between the two cans.

For example, one alternative embodiment of the invention comprises a can body having the combination of the Two Configuration Bottom feature and the Wide Annular Dimensions feature. Another alternative embodiment of the invention comprises a can body having the combination of the Two Configuration Bottom feature and the Substitute Bearing Surfaces feature. A further alternative embodiment of the invention comprises a can body having the combination of the Two Configuration Bottom feature and the Substantial Overall Growth feature. Still another alternative embodiment of the invention comprises a can body having the combination of the Two Configuration Bottom feature and the Stackable Final Bottom Configuration feature. Numerous similar combinations of two such features will be readily apparent to those skilled in the art.

In another example, an alternative embodiment of the invention comprises a can body having the combination of the Two Configuration Bottom, the Wide Annular Dimensions feature and the Substitute Bearing Surfaces feature. Another alternative embodiment of the invention comprises a can body having the combination of the Wide Annular Dimensions features, the Substitute Bearing Surfaces features, and the Stackable Final Bottom Configuration feature. Yet another alternative embodiment of the invention comprises a can body having the combination of the Two Configuration Bottom feature, the Substantial Overall Growth feature, and the Stackable Final Bottom Configuration feature. Numerous similar combinations of three such features will be readily apparent to those skilled in the art.

In another example, an alternative embodiment of the invention comprises a can body having the combination of the Two Configuration Bottom feature, the Wide Annular Dimensions feature, the Substitute Bearing Surfaces, and the Substantial Overall Growth feature. In another alternative embodiment of the invention comprises a can body having the combination of the Wide Annular Dimensions feature, the Substitute Bearing Surfaces feature, the Substantial Overall Growth feature, and the Stackable Final Bottom Configuration feature. In yet another alternative embodiment, the current invention comprises a can body having the combination of the Two Configuration Bottom feature, the Substitute Bearing Surfaces feature, the Substantial Overall Growth feature, and the Stackable Final Bottom Configuration feature. Numerous similar combinations of four such features will be readily apparent to those skilled in the art.

In a still further example, an alternative embodiment of the invention comprises a can body having the combination of the Two Configuration Bottom feature, the Wide Annular Dimensions feature, the Substitute Bearing Surfaces feature, the Substantial Overall Growth feature, and the Stackable Final Bottom Configuration feature. Another aspect of the present invention is a method of storing carbonated beverages, utilizing a controlled growth can. One embodiment of this aspect of the invention comprises forming a controlled growth can body 12 having the heel section 30 in the reduced volume heel position and the hinge section 44 in the reduced volume hinge position, filling the internal cavity 23 of can body 12 with beer or other carbonated beverage, seaming a lid 24 to the second end portion 18 of the side wall 14 of the can body with a pressure-tight seal 26, thereby forming a sealed can 10, and thereafter deforming the heel section 30 from the reduced volume heel position into the expanded volume heel position, and the hinge section 44 from the reduced volume hinge position into the expanded volume hinge position by means of an internal pressure within the sealed can.

Another embodiment of this aspect of the present invention comprises the steps of forming a controlled growth can body 12 with the bottom 22 of the body having the heel section 30 in a expanded volume heel position, and the hinge section 44 in the expanded volume hinge position, preparing the can body 12 for a first configuration change, deforming the heel section 30 from the expanded volume heel position into the reduced volume heel position, and the hinge section 44 from the expanded volume hinge position into the reduced volume hinge position, filling the internal cavity 23 of can body 12 with beer or other carbonated beverage, seaming a lid 24 to the second end portion 18 of the side wall 14 of the can body with a pressure-tight seal 26, thereby forming a sealed can 10, and thereafter deforming the heel section 30 from the reduced volume heel position into the expanded volume heel position, and the hinge section 44 from the reduced volume hinge position into the expanded volume hinge position by means of an internal pressure within the sealed can.

The step of preparing for a first configuration change may comprise applying a protective coating to the interior cavity 23 of the can body 12. The coating application is preferably performed before the first configuration change, because the interior contours of the can bottom 22 may be more conducive to even coating prior to the configuration change. The step of preparing for a first configuration change may alternatively comprises various methods of stabilizing the side wall 14 of the can body. This stabilization is required primarily to prevent the very thin side wall 14 of the can body 12 from buckling when axial loads are applied. Stabilization methods may include inserting a flexible bladder into the body 12 and pressurizing the bladder to support the side wall 14. Alternatively, a fixture may be used to seal against the upper end portion 18 of the side wall 14 of the can body 12 so that the can body can be pressurized, and thus the side wall 14 stabilized, without the use of a separate bladder.

In yet another embodiment of the present invention, the step of preparing the can body for a configuration change comprises applying heat to a localized region of the bottom 22 of the can body 12 until the region reaches a predetermined temperature, thus annealing the can body 12 in the heated area. After preparing the can body, an axial load is applied to obtain a desired heel position.

In still another embodiment of the present invention, the can body configuration change step comprises applying a compressive axial force at opposite ends of the can body 12 until the heel section 30 deforms from the expanded volume heel position to the reduced volume heel position, and the hinge section 44 deforms from the expanded volume hinge position to the reduced volume hinge position. In a further embodiment of the present invention, the can body configuration change step comprises connecting the can body 12 at the second end portion 18 of the side wall 14 to a fixture, and spin-forming the features of the bottom 22 until the heel section 30 deforms from the expanded volume heel position to the reduced volume heel position, and the hinge section 44 deforms from the expanded volume hinge position to the reduced volume hinge position. Alternately, this step comprises inserting segmented tooling into the can body 12 until it rests against the interior surface of the heel section 30 of the bottom 22, and applying a compressive axial force to the tooling and to the exterior of nose section 56 of the bottom 22 until the heel section 30 deforms from the expanded volume heel position to the reduced volume heel position, and the hinge section 44 deforms from the expanded volume hinge position to the reduced volume hinge position.

Other embodiments are within the scope of the invention.

I claim:

1. A container body having a bottom wall distendable from an initial configuration into a distended configuration when the pressure within the can body exceeds the external pressure by a predetermined value, said container body comprising:

a generally cylindrical side wall having a bottom wall merging with the lower extremity of said side wall, said bottom wall in said initial configuration having an annular heel section including, viewed in radial cross-section, an upwardly concave curved heel transition section and an inwardly adjacent straight inner heel wall, the inner periphery of said inner heel wall merging with an annular hinge section, said hinge section having, viewed in radial cross-section, a downwardly concave curved hinge transition section and an inwardly adjacent straight inner hinge wall, the inner periphery of said inner hinge wall merging with an annular nose section, said nose section having, viewed in radial cross-section, an upwardly concave curved nose transition section and an inwardly adjacent straight inner nose wall, the inner periphery of said inner nose wall merging with a centrally disposed and downwardly concave dome section;

said bottom wall in said initial configuration defining a first plane passing through the lowermost extremity of said heel section and a second plane passing through the lowermost extremity of said nose section, said first plane being below said second plane and the lowermost extremity of said heel section forming a first bearing surface for said container body when said bottom wall is in said initial configuration;

said heel transition section and said hinge transition section deforming from said initial configuration and said inner heel wall and said inner hinge wall remaining, viewed in radial cross-section, relatively straight when the pressure within the can body exceeds the external pressure by said predetermined value, thereby distending said bottom wall into said distended configuration;

said bottom wall in said distended configuration defining a third plane passing through the lowermost extremity of said nose section, said third plane being below said first plane and the lowermost extremity of said nose section forming a second bearing surface for said container body when said bottom wall is in said distended configuration.

2. A container body according to claim 1, wherein a heel angle is defined by the intersection of an extension of said side wall and an extension of said inner heel wall, and wherein said deformation of said heel transition section when the pressure within the can body exceeds the external pressure by said predetermined value changes said heel angle from a value within the range of about 31° to 75° when said bottom wall is in said initial configuration into a value within the range of about 91° to 132° when said bottom wall is in said distended configuration.

3. A container body according to claim 2, wherein a hinge angle is defined by the intersection of an extension of said inner heel wall and an extension of said inner hinge wall, and wherein said deformation of said hinge transition section when the pressure within the can body exceeds the external pressure by said predetermined value changes said hinge angle from a value within the range of about 32° to 104° when said bottom wall is in said initial configuration into a value within the range of about 94° to 160° when said bottom wall is in said distended configuration.

4. A container body according to claim 2, wherein said deformation of said heel transition section when the pressure within the can body exceeds the external pressure by said predetermined value changes said heel angle from a value within the range of about 37° to 60° when said bottom wall is in said initial configuration into a value within the range of about 104° to 127° when said bottom wall is in said distended configuration.

5. A container body according to claim 4, wherein said deformation of said hinge transition section when the pressure within the can body exceeds the external pressure by said predetermined value changes said hinge angle from a value within the range of about 51° to 83° when said bottom wall is in said initial configuration into a value within the range of about 120° to 153° when said bottom wall is in said distended configuration.

6. A container body according to claim 4, wherein said deformation of said heel transition section when the pressure within the can body exceeds the external pressure by said predetermined value changes said heel angle from a value within the range of about 44° to 48° when said bottom wall is in said initial configuration into a value within the range of about 116° to 122° when said bottom wall is in said distended configuration.

7. A container body according to claim 6, wherein said deformation of said hinge transition section when the pressure within the can body exceeds the external pressure by said predetermined value changes said hinge angle has a value within the range of about 69° to 74° when said bottom wall is in said initial configuration into a value within the range of about 140° to 148° when said bottom wall is in said distended configuration.

8. A container body according to claim 1, wherein said container body is formed of metal.

9. A container body according to claim 8, wherein said metal is aluminum alloy.

10. A container body according to claim 9, wherein said container body is formed by drawing and ironing.

11. A container body according to claim 10, wherein said predetermined value of pressure is within the range of about 10 to 85 psi and the longitudinal distance between the second plane and the third plane is at least about 0.15 inches.

12. A container body according to claim 11, wherein said predetermined value of pressure is within the range of about 22 to 65 psi and the longitudinal distance between the second plane and the third plane is at least about 0.201 inches.

13. A container body according to claim 12, wherein said predetermined value of pressure is within the range of about 24 to 45 psi and the longitudinal distance between the second plane and the third plane is at least about 0.251 inches.

14. A can for storage of pressure-producing contents, comprising:

a container body according to claim 1; and a lid being joined with a pressure tight seal to the uppermost extremity of said side wall after the introduction of said pressure-producing contents into said container body;

said lid having an upwardly raised rim about its periphery and an interior section surrounded by said rim;

said nose section of a first said can being stackable within the rim of a second below-adjacent such can when said bottom wall of said first can is in the initial configuration and when said bottom wall of said first can is in the distended configuration.

15. A can body having a bottom wall distending downwardly from a reduced volume configuration to an expanded volume configuration when the pressure within the can body exceeds the external pressure by a predetermined value, said can body comprising:

a) a generally cylindrical side wall having upper and lower end portions and a longitudinal central axis; and b) a bottom wall being integral with the lower end portion of said side wall, said bottom wall including an annular heel section defining a heel angle, an annular hinge section defining a hinge angle, an annular nose section defining a nose angle, and an upwardly projecting dome section;

said heel section including, viewed in radial cross section, a curved heel transition section and an inwardly adjacent generally straight inner heel wall;

said heel angle being formed by the intersection of a line constituting an extension of said side wall and a line constituting an extension of said inner heel wall;

said hinge section merging with the inner periphery of said inner heel wall and including, viewed in radial cross section, a curved hinge transition section and an inwardly adjacent generally straight inner hinge wall;

said hinge angle being formed by the intersection of a line constituting an extension of said inner heel wall and a line constituting an extension of said inner hinge wall;

said nose section merging with the inner periphery of said inner hinge wall and including, viewed in radial cross section, a curved nose transition section and an inwardly adjacent generally straight inner nose wall;

said nose angle being formed by the intersection of a line constituting an extension of said inner hinge wall and a line constituting an extension of said inner nose wall; and said dome section merging with an inner periphery of said inner nose wall;

said bottom wall in said reduced volume configuration defining a first plane passing through the lowermost extremity of said heel section and a second plane passing through the lowermost extremity of said nose section, said first plane being below said second plane and said lowermost extremity of said heel section forming a first bearing surface for said container body when said bottom wall is in said initial configuration;

said heel transition section and said hinge transition section deforming when the pressure within the can body exceeds the external pressure by said predetermined value and changing both of said heel angle and said hinge angle from acute angles when said bottom wall is in said reduced volume configuration into obtuse angles when said bottom wall is in said expanded volume configuration while both of said inner heel wall and said inner hinge wall remain generally straight;

said bottom wall in said expanded volume configuration defining a third plane passing through the lowermost extremity of said nose section, said third plane being below said first plane and said lowermost extremity of said nose section forming a second bearing surface for said container body when said bottom wall is in said expanded volume configuration.

16. A can body according to claim 15, wherein when said bottom wall in said reduced volume configuration said heel angle and said hinge angle are each greater than said nose angle.

17. A can body according to claim 15, wherein the generally straight inner heel wall, viewed in radial cross-section, is connected between a point tangent to the curved heel transition section and a point tangent to the curved hinge transition section and has a length not less than the smaller of the radius of curvature of said heel transition section and the radius of curvature of said hinge transition section.

18. A can body according to claim 17, wherein the generally straight inner hinge wall, viewed in radial cross-section, is connected between a point tangent to the curved hinge transition section and a point tangent to the curved nose transition section and has a length not less than the smaller of the radius of curvature of said hinge transition section and the radius of curvature of said nose transition section.

* * * * *